US008353361B2

(12) United States Patent
Suzuki et al.

(10) Patent No.: US 8,353,361 B2
(45) Date of Patent: Jan. 15, 2013

(54) PNEUMATIC TOOL

(75) Inventors: Yasumasa Suzuki, Tokyo (JP); Katsunobu Kishi, Tokyo (JP); Kuniaki Shibuya, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 288 days.

(21) Appl. No.: 12/671,339

(22) PCT Filed: Jul. 23, 2008

(86) PCT No.: PCT/JP2008/063174

§ 371 (c)(1),
(2), (4) Date: Apr. 13, 2010

(87) PCT Pub. No.: WO2009/017002

PCT Pub. Date: Feb. 5, 2009

(65) Prior Publication Data

US 2010/0200259 A1 Aug. 12, 2010

(30) Foreign Application Priority Data

Jul. 31, 2007 (JP) ..... 2007-200045

(51) Int. Cl.

| | |
|---|---|
| ***B23B 45/04*** | (2006.01) |
| ***B23B 45/00*** | (2006.01) |
| ***B27C 3/08*** | (2006.01) |
| ***B25D 17/04*** | (2006.01) |

(52) U.S. Cl. ..... 173/169; 173/170; 173/171

(58) Field of Classification Search ..... 173/104–111, 173/135–138, 200, 168, 169–171, 218–221; 227/112, 130; 30/228; *B25D 45/16, 11/00, B25D 13/00, 9/00, 17/04; E21B 1/00; B23B 3/16, 45/00, 45/04; B27C 3/08*

See application file for complete search history.

(56) References Cited

U.S. PATENT DOCUMENTS 1,382,775 A * 6/1921 Gilman ..... 173/18

(Continued)

FOREIGN PATENT DOCUMENTS

JP 5-5383 1/1993

(Continued)

OTHER PUBLICATIONS

Office Action issued Sep. 20, 2011 in corresponding Japanese Application No. 2007-200045 (with partial English translation).

(Continued)

*Primary Examiner* — Robert F Long

(74) *Attorney, Agent, or Firm* — Wenderoth, Lind & Ponack, L.L.P.

(57) ABSTRACT

A pneumatic tool which can be easily assembled. This pneumatic tool includes a tool housing and an air supply pipe. The tool housing includes a motor housing having a tubular wall, and a tubular air supply/exhaust portion connected to the side surface of the tubular wall and extending rearwardly of the pneumatic tool. The air supply pipe has a valve unit, and is inserted into and set in the air supply/exhaust portion. The air supply/exhaust portion has an air supply passage extending from the motor housing. When the air supply pipe is inserted into and fixed to the air supply/exhaust portion, the forward end portion of the air supply pipe is communicated with a rear end opening of the air supply passage of the air supply/exhaust portion, whereby a compressed air supply passage to an air motor is formed.

8 Claims, 4 Drawing Sheets

U.S. PATENT DOCUMENTS

| | | | | | |
|---|---|---|---|---|---|
| 2,183,150 | A | * | 12/1939 | Patterson | 15/379 |
| 2,950,775 | A | * | 8/1960 | Zwayer | 181/230 |
| 3,343,613 | A | * | 9/1967 | Carnesecca, Jr. et al. | 173/169 |
| 3,421,392 | A | * | 1/1969 | Bangerter et al. | 408/57 |
| 3,695,367 | A | * | 10/1972 | Catterfeld et al. | 173/221 |
| 3,858,444 | A | * | 1/1975 | Wallace | 73/862.21 |
| 3,934,657 | A | * | 1/1976 | Danielson | 173/169 |
| 4,210,975 | A | * | 7/1980 | Teague et al. | 15/22.1 |
| 5,755,292 | A | * | 5/1998 | Nilsson et al. | 173/13 |
| 5,992,540 | A | * | 11/1999 | Smolinski et al. | 173/169 |
| 6,062,323 | A | | 5/2000 | Pusateri et al. | |
| 6,135,213 | A | * | 10/2000 | Schoeps | 173/93.5 |
| 6,149,356 | A | * | 11/2000 | Chu et al. | 408/56 |
| 6,547,015 | B1 | * | 4/2003 | Nowak et al. | 173/169 |
| 6,644,419 | B1 | * | 11/2003 | Chen | 173/169 |
| 6,802,766 | B2 | * | 10/2004 | Liu | 451/451 |
| 6,886,803 | B2 | * | 5/2005 | Mikiya et al. | 251/149.1 |
| 6,953,095 | B2 | * | 10/2005 | Randa | 173/1 |
| 7,131,458 | B2 | * | 11/2006 | Kohda | 137/614.03 |
| 7,464,768 | B2 | * | 12/2008 | Wang | 173/168 |
| 8,020,304 | B2 | * | 9/2011 | Mace et al. | 30/381 |
| 8,033,343 | B2 | * | 10/2011 | Barrows et al. | 173/78 |
| 2003/0121680 | A1 | * | 7/2003 | Izumisawa et al. | 173/93.5 |
| 2011/0036606 | A1 | * | 2/2011 | Young et al. | 173/104 |
| 2011/0269101 | A1 | * | 11/2011 | Duesing et al. | 433/126 |

FOREIGN PATENT DOCUMENTS

| | | | | |
|---|---|---|---|---|
| JP | 7-314316 | | | 12/1995 |
| JP | 2519937 | | | 9/1996 |
| JP | 2694329 | | | 9/1997 |
| JP | 2001-138267 | | | 5/2001 |
| JP | 2002-521219 | | | 7/2002 |
| JP | 2004058216 | A | * | 2/2004 |
| JP | 2006-75920 | | | 3/2006 |
| JP | 2007-168036 | | | 7/2007 |
| JP | 2008194769 | A | * | 8/2008 |
| JP | 2009034753 | A | * | 2/2009 |
| WO | 00/05036 | | | 2/2000 |
| WO | WO 2008096823 | A1 | * | 8/2008 |

OTHER PUBLICATIONS

Office Action issued Oct. 12, 2011 in counterpart Korean Application No. 2010-7002190 (with English translation).

International Search Report issued Aug. 19, 2008 in corresponding International Application No. PCT/JP2008/063174.

* cited by examiner

PNEUMATIC TOOL

TECHNICAL FIELD

The present invention relates to a pneumatic tool, such as an endless belt type grinding tool, driven by means of an air motor.

BACKGROUND ART

This kind of pneumatic tool includes a housing. The housing has a motor housing for housing an air motor, and an air supply/exhaust portion which is connected to the motor housing and in which an air supply passage and an exhaust passage to and from the air motor are formed. The air supply/exhaust portion is provided with a valve unit for controlling air supply (for example, see Patent Document 1).

Patent Document 1: Japanese Registered Utility Model No. 2519937

DISCLOSURE OF THE INVENTION

Problems to be Solved by the Invention

The valve unit in the above type of pneumatic tool includes a valve housing having an air supply passage communicated with the air supply passage of the tool housing, and a valve member disposed in the air supply passage for supplying compressed air, stopping the supply, and controlling the flow rate of compressed air. In installation of the valve unit to the tool housing, the valve housing is first inserted into the air supply/exhaust portion of the tool housing. Then, screws are passed through screw holes formed in a wall disposed in the front of the valve housing in the inserting direction. The screws are then screwed into a wall of the tool housing, whereby the valve housing is fixed in the air supply/exhaust portion. After that, the valve member and associated components such as a spring member are installed in the valve housing, whereby the installation of the valve unit is completed.

Installation of such a valve unit is complicated, time-consuming, and inefficient.

It is therefore an object of the present invention to simplify the installation of the valve unit for efficient operation so that the pneumatic tool can be assembled efficiently.

Means for Solving the Problems

The present invention provides a pneumatic tool which comprises a tool housing (18) including a motor housing (16) having a tubular wall (indicated by reference numeral 14 in the embodiment described below) for housing an air motor, and a tubular air supply/exhaust portion (34) connected to a lateral side of the tubular wall of the motor housing and extending rearward of the pneumatic tool to a rear opening end portion of the tubular air supply/exhaust portion. The tool housing (18) further includes an air inlet (52) and an air outlet (53) for the air motor extending through the tubular wall of the motor housing, and an air supply passage (56) defined in the air supply/exhaust portion (34). The air supply passage (56) fluidly communicates with the air inlet (52) and has a rear end opening (56*c*) directed toward a rear of the pneumatic tool. An air supply pipe (36) has a rear end, a forward end and an air passage extending forward from a compressed air intake port (38) that is formed in the rear end and configured to be connected to a compressed air source to a compressed air exhaust port (40) formed in the forward end. The air supply pipe (36) includes a valve unit (an on-off valve 46 and a flow regulating valve 48 in the embodiment) for controlling compressed air flowing through the air passage of the air supply pipe (36). The air supply pipe (36) is configured to be inserted into the air supply/exhaust portion (34) of the tool housing (18) from the rear opening end portion thereof with the compressed air exhaust port (40) directed forward so that the air supply pipe (36) is fixed to the air supply/exhaust portion to form a compressed air supply passage extending from the compressed air intake port (38) to the air inlet (52) for the air motor through the valve unit (46, 48), the compressed air exhaust port (40), and the rear end opening, and to form a compressed air exhaust passage passing through the air outlet (53) that extends through the tubular wall of the motor housing and opens to an inside of the air supply/exhaust portion (34) and between an inner peripheral surface of the air supply/exhaust portion and an outer peripheral surface of the air supply pipe (36).

In this pneumatic tool, the air supply pipe (36) is inserted into and fixed to the air supply/exhaust portion of the tool housing (18), whereby the air supply passage and the exhaust passage to and from the air motor are completed. Thus, assembling operation can be remarkably simplified thereby to improve working efficiency significantly, as compared with the above-described pneumatic tool.

Specifically, the air supply pipe (36) has a plate-shaped lid member (90) around an outer peripheral surface of the rear end thereof and the lid member is configured to be engaged with the rear opening end portion of the air supply/exhaust portion (34) to positively locate the air supply pipe relative to the air supply/exhaust portion (34).

More specifically, the lid member (90) has an inner surface (90*a*) which, when the lid member is engaged with the rear opening end portion of the air supply/exhaust portion (34), faces toward the inside of the rear opening end portion of the air supply/exhaust portion, an outer surface opposite (90*b*) to the inner surface, a hole (91) extending through the lid member from the inner surface to the outer surface, and an exhaust pipe (50) attached to the outer surface of the lid member and communicated through the hole with the inside of the tool housing.

Further, when the air supply pipe (36) is inserted into the air supply/exhaust portion of the tool housing, the outer peripheral surface of the air supply pipe engages with the inner peripheral surface of the air supply/exhaust portion (34) so that the air supply pipe is positively located relative to the air supply/exhaust portion. Specifically, the air supply pipe (36) has at least one reinforcing rib (97,98) longitudinally extending along the air supply pipe. When the air supply pipe is inserted into the air supply/exhaust portion of the tool housing, the reinforcing rib of the air supply pipe engages with the inner peripheral surface of the air supply/exhaust portion.

As described above, the lid member is fitted in the rear opening end portion of the air supply/exhaust portion (34) and the outer peripheral surface of the air supply pipe (36) is engaged with the inner peripheral surface of the air supply/exhaust portion (34), whereby the relative position of the air supply pipe (36) with respect to the air supply/exhaust portion of the tool housing can be determined. Thus, it is possible to easily align the compressed air exhaust port at the forward end of the air supply pipe with respect to the rear end opening of the air supply passage to the air inlet of the air motor of the tool housing.

Furthermore, the pneumatic tool may be arranged as follows. A forward end portion (60) of the air supply pipe has an annular flange (62) at a position spaced from the forward end thereof and an O-ring (63) disposed around the forward end portion (60). The tool housing has an annular rear end surface defining the rear end opening of the air supply passage (56) of the tool housing. The air supply passage (56) of the tool housing is configured to receive the forward end portion (60) of the air supply pipe. The rear end opening of the air supply passage has a large-diameter portion (56*b*) which, when the air supply passage (56) receives the forward end portion (60) of the air supply pipe, receives the O-ring (63) disposed around the forward end portion to sealingly engage with the O-ring.

With such an arrangement, when the air supply pipe (36) is inserted into the air supply/exhaust portion, the forward end portion of the air supply pipe (36) is first inserted into the large-diameter portion (56*b*) of the rear end opening of the air supply passage (56) of the tool housing. Then, when the air supply pipe is further inserted, the O-ring (63) around the forward end portion of the air supply pipe is moved into the large-diameter portion to align the forward end portion (60) with respect to the air supply passage. Thus, the forward end portion can be securely inserted into the air supply passage.

BEST MODE FOR CARRYING OUT THE INVENTION

Figure 1:
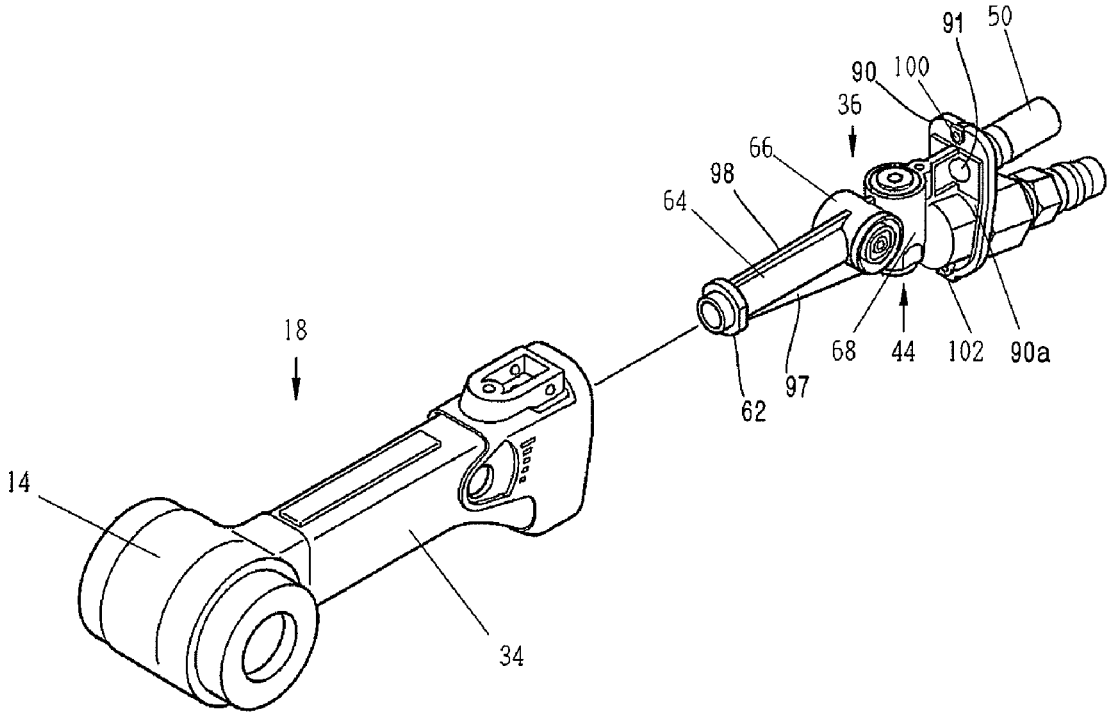
FIG. 1 is an exploded perspective view of a tool housing and an air supply pipe to be inserted into and set in the tool housing, which constitute a pneumatic tool according to the present invention.

An embodiment of a pneumatic tool according to the present invention will now be described with reference to the accompanying drawings.

A pneumatic tool 10 shown in the figure is an endless belt type grinding tool driven by means of an air motor 12.

The pneumatic tool 10 includes a tool housing 18 provided with a motor housing 16 having a tubular wall 14 for housing the air motor 12. The air motor 12 has a rotational shaft 20, and the rotational shaft projects outwardly from one end wall (lower end wall as viewed in FIG. 2) of the tubular wall 14 to constitute a drive shaft 22. A rear pulley 24 is fixed to the drive shaft 22. The rear pulley 24 is configured to drive an endless belt-shaped grinding tool 30 wound between a front pulley 28 attached to the forward end of a pulley support rod 26 extending forwardly from the tool housing and the rear pulley 24. In the figure, reference numeral 32 denotes a cover attached to the tool housing 18 for covering the rear pulley 24 and the grinding tool 30.

Figure 3:
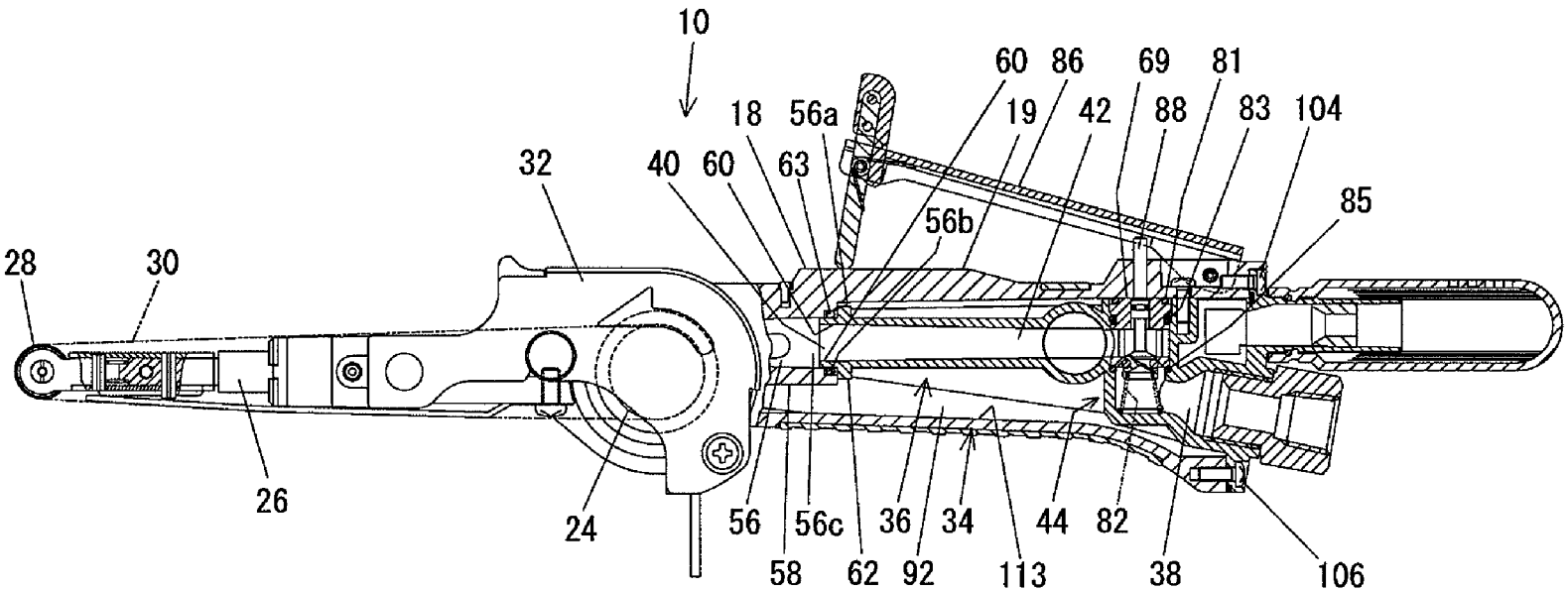
FIG. 3 is a partial sectional side view of the pneumatic tool.
Figure 4:
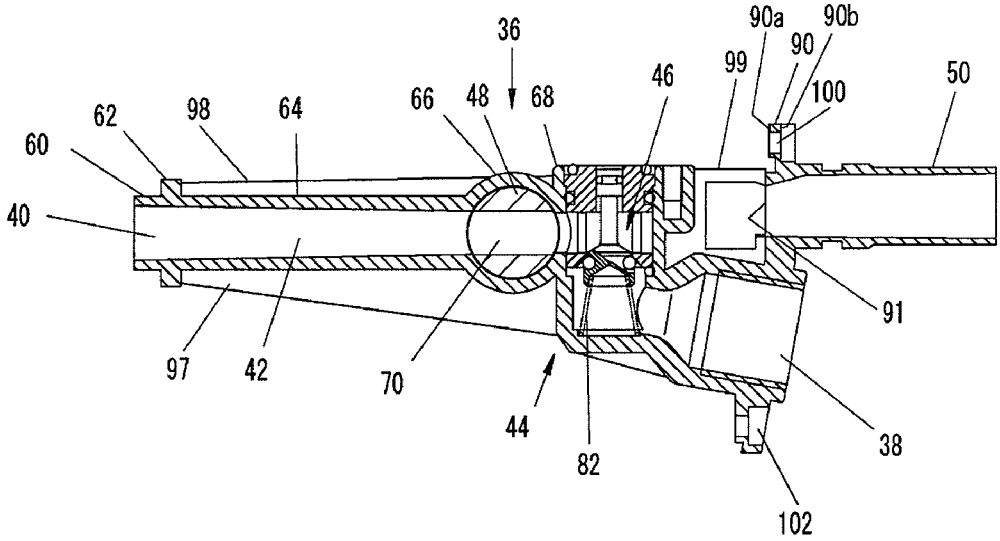
FIG. 4 is an enlarged longitudinal sectional view of the air supply pipe of the pneumatic tool shown in FIG. 3.

A tubular air supply/exhaust portion 34 is provided so as to extend rearwardly from the rear side of the tubular wall 14 of the tool housing 18. An air supply pipe 36 is inserted into and set in the air supply/exhaust portion 34 from a rear end opening of the air supply/exhaust portion. The air supply pipe 36 has an air supply pipe passage 42 extending from a compressed air intake port 38 disposed at the rear end thereof and connected to a compressed air source (not shown) to a compressed air exhaust port 40 at the forward end thereof (FIG. 3, FIG. 4).

In the illustrated example, the air supply pipe passage is configured to extend straight rearwardly from the compressed air exhaust port 40 through a bent portion 44 to the compressed air intake port 38. An on-off valve 46 is provided in the bent portion 44, and a flow regulating valve 48 is provided downstream of the on-off valve. Further, in the illustrated example, an exhaust pipe 50 described below is formed integrally with the air supply pipe 36 at the rear portion of the air supply pipe.

The tubular wall 14 for housing the air motor 12 has an air inlet 52 (FIG. 2) and an air outlet 53 (FIG. 5) passing through the tubular wall 14.

The air supply/exhaust portion 34 has therein at the forward end thereof a short tubular portion 58 (FIG. 3, FIG. 4) defining an air supply passage 56 which communicates with the air inlet 52 of the air motor and extends rearwardly. A forward end portion 60 of the air supply pipe 36 inserted into and set in the air supply/exhaust portion 34 is inserted into the rear end of the tubular portion 58. The forward end portion 60 of the air supply pipe 36 is provided, at a position spaced rearwardly from the forward end thereof, with an annular flange 62. The flange 62 is configured to abut against an annular rear end surface 56*a* (FIG. 3) defining a rear end opening 56*c* of the air supply passage 56. An O-ring 63 is provided around the forward end portion, and is fitted in a large-diameter portion 56*b* of the rear end opening of the air supply passage 56.

The air supply pipe 36 has a pipe-shaped portion 64 extending straight rearwardly from the compressed air exhaust port 40, a tubular flow regulating valve housing 66 disposed between the pipe-shaped portion 64 and the bent portion 44, and a tubular on-off valve housing 68 constituting the bent portion 44. The flow regulating valve housing 66 has an axis perpendicular to an axis of the pipe-shaped portion 64. In the illustrated example, the axis of the flow regulating valve housing 66 extends horizontally. The on-off valve housing 68 has an axis extending perpendicularly to axis of the pipe-shaped portion 64 and the flow regulating valve housing 66 (i.e., extending vertically as viewed in the illustrated example).

Figure 2:
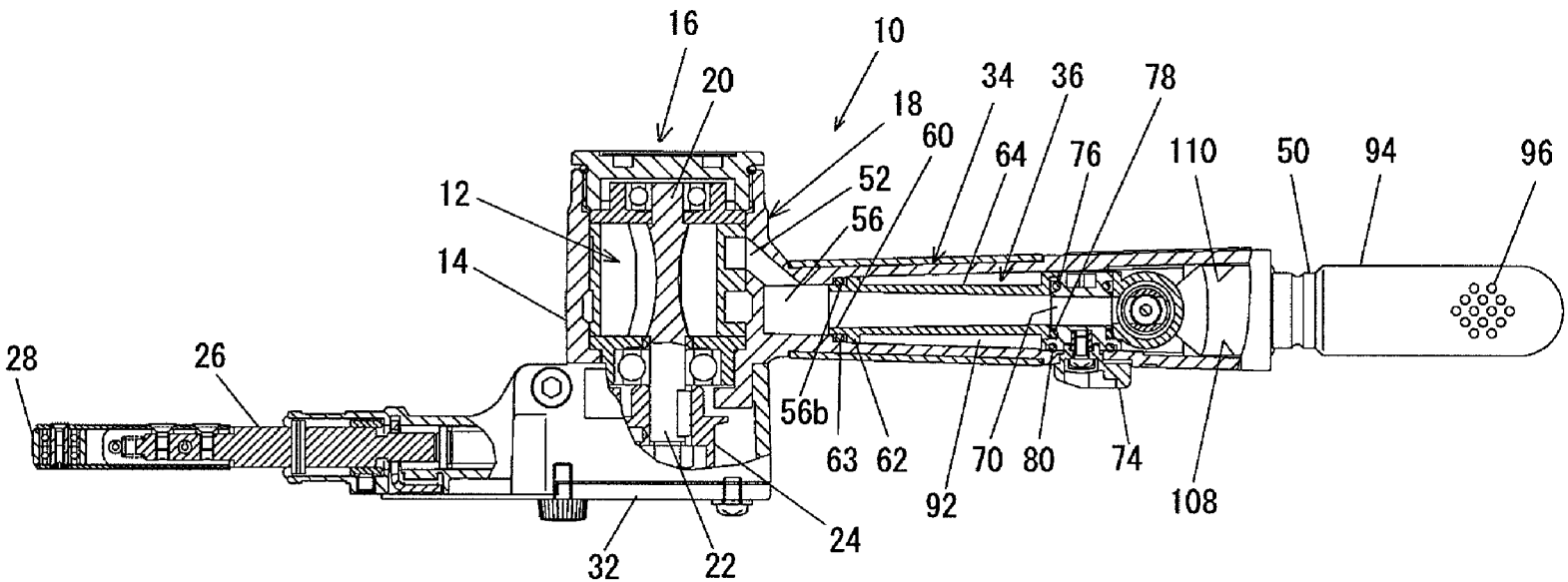
FIG. 2 is a partial sectional plan view of the pneumatic tool.

The flow regulating valve housing 66 is provided with the generally cylindrical flow regulating valve 48. The flow regulating valve 48 has, at the central portion in the axial direction thereof, a flow passage 70 formed so as to be perpendicular to the axis. As shown in FIG. 2, the air supply/exhaust portion 34 has, in the side wall thereof, an opening that is coaxial with the flow regulating valve 48. A lever 74 for rotating the flow regulating valve 48 about the axis of the flow regulating valve thereby to regulate flow rate is screwed through the opening to the side wall of the air supply/exhaust portion. In the figure, reference numerals 76, 78, 80 denote O-rings for the flow regulating valve housing 66.

A poppet valve, i.e., the on-off valve 46, biased by a spring 82 is axially displaceably housed in the on-off valve housing 68 so as not to project from the top surface of the on-off valve housing 68. A top wall 19 of the tool housing 18 is provided with an operational rod 88 slidably disposed in a through hole formed along the axis of the on-off valve housing 68, and a pivot lever 86 for pressing the operational rod 88. When the pivot lever 86 is pivotally moved in the counterclockwise direction as viewed in FIG. 3, the operational rod 88 is pushed down to open the on-off valve 46, whereby compressed air can be supplied to the air motor. The pivot lever 86 is at a position shown in FIG. 3 in an ordinary state. The operational rod 88 pushed upward by the on-off valve 46 is configured not to slip out of the top wall 19 in a state in which the pivot lever is at this position. In the figure, reference numerals 81, 83, 85 denote O-rings for the on-off valve.

A plate-shaped lid member 90 is provided around the outer periphery of the rear end, where the compressed air intake port 38 is disposed, of the air supply pipe 36 so as to be generally perpendicular to the axis of the pipe-shaped portion 64 of the air supply pipe 36. The lid member 90 is configured to be fitted in the rear end opening of the air supply/exhaust portion 34 of the tool housing. The above-described exhaust pipe 50 is formed so as to extend rearwardly from the lid member 90, and is communicated with the inside of the air supply/exhaust portion through a hole 91 formed in the lid member 90 so as to pass therethrough from an outer surface 90*b* to an inner surface 90*a* thereof. The above-described air outlet of the air motor 12 is open to the inside of the forward end of the air supply/exhaust portion 34 of the tool housing 18, and is communicated with the exhaust pipe 50 through an exhaust passage 92 formed between the inner wall surface of the air supply/exhaust portion 34 and the outer peripheral surface of the air supply pipe 36 and through the hole 91 of the lid member 90. Exhaust air from the air motor is exhausted through the exhaust pipe to the outside. In the figure, reference numeral 94 denotes a diffuser tube disposed so as to cover the exhaust pipe 50, and exhaust air is diffused through a plurality of diffuser holes 96 to the outside.

In the illustrated embodiment, reinforcing ribs 97 and 98 are formed, at the upper portion and the lower portion, respectively, of the pipe-shaped portion 64, integrally with the air supply pipe 36 so as to extend along the longitudinal direction of the pipe-shaped portion. In addition, a C-shaped reinforcing member 99 is formed, between the on-off valve housing 68 and the lid member 90, integrally with the air supply pipe 36.

When this pneumatic tool 10 is assembled, first, the flow regulating valve 48, the on-off valve 46, O-rings 76, 78, 80, 81, 83, 85, which are associated with these valves, the spring 82, and the like are installed in the air supply pipe 36. Then, the air supply pipe is inserted into the air supply/exhaust portion 34 of the tool housing 18. After that, screws 104, 106 are screwed into screw holes of the tool housing through holes 100, 102 formed in the lid member 90, thereby fixing the air supply pipe to the tool housing. Then, after an air motor unit is installed, a cover unit to which the pulley support rod is attached is installed.

Figure 5:
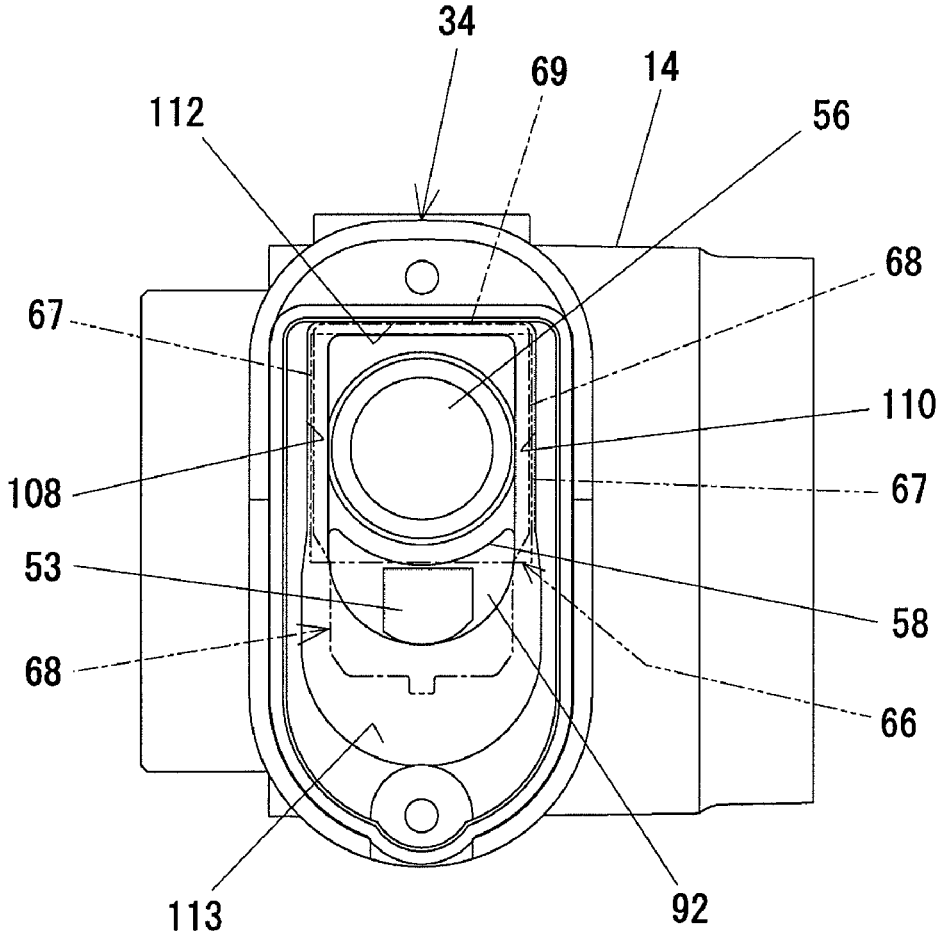
FIG. 5 is a rear end view of an air supply/exhaust portion of the pneumatic tool, showing the positional relationship between the inner peripheral surface of the air supply/exhaust portion, and an on-off valve housing and a flow regulating valve housing of the air supply pipe.

As shown in FIG. 5, the air supply/exhaust portion 34 of the tool housing has opposing inner wall surfaces 108, 110 (FIG. 2) slightly inclined so as to approach each other toward the motor housing 16, a generally horizontal top wall surface 112 (FIG. 5), and a bottom wall surface 113 (FIGS. 3 and 5) inclined upwardly toward the motor housing 16. When the air supply pipe 36 is inserted into the air supply/exhaust portion 34, opposing end surfaces 67, 67 of the tubular flow regulating valve housing 66 come almost into contact with the opposing inner wall surfaces 108, 110, respectively, and a top end surface 69 of the tubular on-off valve housing 68 comes generally into contact with the top wall surface 112. In the illustrated example, one of the end surfaces 67 of the flow regulating valve housing 66 is in contact with the inner wall surface 108 through the O-ring 80 (FIG. 2), and the top end surface 69 of the on-off valve housing 68 is in contact with the top wall surface 112 through the 0-ring 81 (FIG. 3). The lid member 90 formed integrally with the air supply pipe 36 is configured to be fitted in the rear end opening of the air supply/exhaust portion of the tool housing, as described above. Thus, when the air supply pipe 36 is inserted into the air supply/exhaust portion 34 of the tool housing, the relative position of the air supply pipe 36 with respect to the air supply/exhaust portion 34 is automatically determined, whereby the forward end portion 60 of the pipe-shaped portion 64 of the air supply pipe is securely inserted into the tubular portion 58 defining the air supply passage 56 of the tool housing.

In the endless belt type grinding tool as the illustrated pneumatic tool, the air supply/exhaust portion 34 is configure to be a grip portion for an operator. The air supply/exhaust portion 34 is covered with a heat insulating sheet (not shown) to block the transfer of cooling effect by adiabatic expansion of compressed air caused in the tool.

The invention claimed is:

1. A pneumatic tool comprising:

a tool housing including a motor housing for housing an air motor, and a tubular air supply/exhaust portion having a forward end connected to a rear side wall of the motor housing, a rear end, and a longitudinal passage extending rearward from the forward end through the supply/exhaust portion and opening at the rear end, the tool housing further including an air inlet and an air outlet for the air motor, which extends through the rear side wall of the motor housing, and an air supply tubular portion provided inside the forward end of the air supply/exhaust portion, the air supply tubular portion having an air supply passage that has a forward end fluidly communicating with the air inlet and a rear end positioned in the longitudinal passage and directed toward the rear end of the air supply/exhaust portion, the air outlet enabling the air motor to fluidly communicate with the longitudinal passage of the air supply/exhaust portion; and an air supply pipe having a rear air inlet end configured to be connected to a compressed air source, a forward air outlet end fluidly connected to the rear end of the air supply tubular portion and an air passage (42) extending through the air supply pipe from the rear air inlet end to the forward air outlet end, the air supply pipe further including a valve unit for controlling compressed air flowing through the air passage of the air supply pipe, wherein the air supply pipe is configured to be inserted into the longitudinal passage of the air supply/exhaust portion from the rear end thereof with the forward air outlet end directed forward so that the air supply pipe is fixed in the air supply/exhaust portion with the forward air outlet end fluidly connected to the rear end of the air supply tubular portion to define a compressed air supply passage extending from the rear air inlet end of the air supply pipe to the air inlet for the air motor through the air passage, and to define an air exhaust passage extending rearward from the air outlet for the air motor through a space between an interior peripheral surface of the air supply/exhaust portion and an outer peripheral surface of the air supply pipe;

wherein the air supply pipe has a plate-shaped lid member around an outer peripheral surface of the rear air inlet end thereof;

the lid member is configured to be engaged with the rear end of the air supply/exhaust portion to positively locate the air supply pipe relative to the air supply/exhaust portion;

the forward air outlet end of the air supply pipe has an annular flange thereon and there around, and an O-ring disposed there around, the O-ring being positioned forward of and adjacent to the annular flange;

the air supply tubular portion is configured to receive the forward air outlet end portion of the air supply pipe; and the rear end of the air supply passage has a large-diameter portion which, when the rear end of the air supply passage receives the forward air inlet end of the air supply pipe, receives the O-ring disposed around the forward air outlet end to sealingly engage with the O-ring.

2. A pneumatic tool according to claim 1, wherein the lid member has an inner surface which, when the lid member is engaged with the rear end of the air supply/exhaust portion, faces the longitudinal passage of the air inlet/exhaust portion, an outer surface opposite to the inner surface, a hole extending through the lid member from the inner surface to the outer surface, and an exhaust pipe attached to the outer surface of the lid member and communicated through the hole with the longitudinal passage of the air inlet/exhaust portion.

3. A pneumatic tool according to claim 1, wherein an outer peripheral surface of the air supply pipe engages with the interior peripheral surface of the air supply/exhaust portion so that the air supply pipe is positively located relative to the air supply/exhaust portion.

4. A pneumatic tool according to claim 3, wherein the air supply pipe has at least one reinforcing rib longitudinally extending along the air supply pipe, and wherein when the air supply pipe is inserted into the air supply/exhaust portion, the reinforcing rib of the air supply pipe engages with the interior peripheral surface of the air supply/exhaust portion.

5. A pneumatic tool according to claim 1, wherein an outer peripheral surface of the air supply pipe engages with the interior peripheral surface of the air supply/exhaust portion so that the air supply pipe is positively located relative to the air supply/exhaust portion.

6. A pneumatic tool according to claim 2, wherein an outer peripheral surface of the air supply pipe engages with the interior peripheral surface of the air supply/exhaust portion so that the air supply pipe is positively located relative to the air supply/exhaust portion.

7. A pneumatic tool according to claim 5, wherein the air supply pipe has at least one reinforcing rib longitudinally extending along the air supply pipe, and wherein when the air supply pipe is inserted into the air supply/exhaust portion, the reinforcing rib of the air supply pipe engages with the interior peripheral surface of the air supply/exhaust portion.

8. A pneumatic tool according to claim 6, wherein the air supply pipe has at least one reinforcing rib longitudinally extending along the air supply pipe, and wherein when the air supply pipe is inserted into the air supply/exhaust portion, the reinforcing rib of the air supply pipe engages with the interior peripheral surface of the air supply/exhaust portion.

* * * * *